US011180986B2

(12) United States Patent
Morrow et al.

(10) Patent No.: US 11,180,986 B2
(45) **Date of Patent: *Nov. 23, 2021**

(54) DISCRETE WELLBORE DEVICES, HYDROCARBON WELLS INCLUDING A DOWNHOLE COMMUNICATION NETWORK AND THE DISCRETE WELLBORE DEVICES AND SYSTEMS AND METHODS INCLUDING THE SAME

(71) Applicant: ExxonMobil Upstream Research Company, Spring, TX (US)

(72) Inventors: Timothy I. Morrow, Humble, TX (US); Renzo M. Angeles Boza, Houston, TX (US); Bruce A. Dale, Sugar Land, TX (US)

(73) Assignee: ExxonMobil Upstream Research Company, Spring, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/675,979

(22) Filed: Nov. 6, 2019

(65) Prior Publication Data

US 2020/0072043 A1 Mar. 5, 2020

Related U.S. Application Data

(62) Division of application No. 14/820,616, filed on Aug. 7, 2015, now Pat. No. 10,508,536.

(Continued)

(51) Int. Cl.
*E21B 47/12* (2012.01)
*E21B 47/14* (2006.01)

(Continued)

(52) U.S. Cl.
CPC ..... *E21B 47/12* (2013.01); *E21B 43/11* (2013.01); *E21B 47/09* (2013.01); *E21B 47/14* (2013.01)

(58) Field of Classification Search
CPC ..... E21B 44/00; E21B 44/005; E21B 47/09; E21B 47/12; E21B 47/14
See application file for complete search history.

(56) References Cited

U.S. PATENT DOCUMENTS

| | | | | |
|---|---|---|---|---|
| 3,103,643 | A | 9/1963 | Kalbfell | 340/17 |
| 3,205,477 | A | 9/1965 | Kalbfell | 340/18 |

(Continued)

FOREIGN PATENT DOCUMENTS

| | | | | |
|---|---|---|---|---|
| CN | 102733799 | 6/2014 | ..... | E21B 47/16 |
| EP | 0636763 | 2/1995 | ..... | E21B 47/12 |

(Continued)

OTHER PUBLICATIONS

U.S. Appl. No. 15/666,334, filed Aug. 1, 2017, Walker, Katie M. et al.

(Continued)

*Primary Examiner* — Christopher J Sebesta
*Assistant Examiner* — Lamia Quaim
(74) *Attorney, Agent, or Firm* — Leandro Arechederra, III

(57) ABSTRACT

Discrete wellbore devices, hydrocarbon wells including a downhole communication network and the discrete wellbore devices, and systems and methods including the same are disclosed herein. The discrete wellbore devices include a wellbore tool and a communication device. The wellbore tool is configured to perform a downhole operation within a wellbore conduit that is defined by a wellbore tubular of the hydrocarbon well. The communication device is operatively coupled for movement with the wellbore tool within the wellbore conduit. The communication device is configured to communicate with a downhole communication network that extends along the wellbore tubular via a wireless communication signal. The methods include actively and/or passively detecting a location of the discrete wellbore device (Continued)

within the wellbore conduit. The methods additionally or alternatively include wireless communication between the discrete wellbore device and the downhole communication network.

35 Claims, 4 Drawing Sheets

Related U.S. Application Data

(60) Provisional application No. 62/049,513, filed on Sep. 12, 2014.

(51) Int. Cl.
*E21B 43/11* (2006.01)
*E21B 47/09* (2012.01)

(56) References Cited

U.S. PATENT DOCUMENTS 3,512,407 A 5/1970 Zill ..... 73/152
3,637,010 A 1/1972 Malay et al. ..... 166/51
3,741,301 A 6/1973 Malay et al. ..... 166/191
3,781,783 A 12/1973 Tucker ..... 340/18
3,790,930 A 2/1974 Lamel et al. ..... 340/18
3,900,827 A 8/1975 Lamel et al. ..... 340/18
3,906,434 A 9/1975 Lamel et al. ..... 340/18
4,001,773 A 1/1977 Lamel et al. ..... 340/18
4,283,780 A 8/1981 Nardi ..... 367/82
4,298,970 A 11/1981 Shawhan et al. ..... 367/82
4,302,826 A 11/1981 Kent et al. ..... 367/82
4,314,365 A 2/1982 Peterson et al. ..... 367/82
4,884,071 A 11/1989 Howard ..... 340/854
4,962,489 A 10/1990 Medlin et al. ..... 367/32
5,128,901 A 7/1992 Drumheller ..... 367/82
5,136,613 A 8/1992 Dumestre, III ..... 375/1
5,166,908 A 11/1992 Montgomery ..... 367/165
5,182,946 A 2/1993 Boughner et al. ..... 13/151
5,234,055 A 8/1993 Cornette ..... 166/278
5,283,768 A 2/1994 Rorden ..... 367/83
5,373,481 A 12/1994 Orban et al. ..... 367/82
5,468,025 A 11/1995 Adinolfe et al. ..... 285/114
5,480,201 A 1/1996 Mercer ..... 294/67.31
5,495,230 A 2/1996 Lian ..... 340/551
5,562,240 A 10/1996 Campbell ..... 227/130
5,592,438 A 1/1997 Rorden et al. ..... 367/83
5,667,650 A 9/1997 Face et al. ..... 204/298.07
5,850,369 A 12/1998 Rorden et al. ..... 367/83
5,857,146 A 1/1999 Kido ..... 455/38.3
5,924,499 A 7/1999 Birchak et al. ..... 175/40
5,960,883 A 10/1999 Tubel et al. ..... 166/313
5,995,449 A 11/1999 Green et al. ..... 367/83
6,049,508 A 4/2000 Deflandre ..... 367/48
6,125,080 A 9/2000 Sonnenschein et al. ..... 367/134
6,128,250 A 10/2000 Reid et al. ..... 367/153
6,177,882 B1 1/2001 Ringgenberg et al. .... 340/853.7
6,236,850 B1 5/2001 Desai ..... 455/343
6,239,690 B1 5/2001 Burbidge et al. ..... 340/10.33
6,300,743 B1 10/2001 Patino et al. ..... 320/106
6,320,820 B1 11/2001 Gardner et al. ..... 367/81
6,324,904 B1 12/2001 Ishikawa et al. ..... 13/152.03
6,360,769 B1 3/2002 Brisco ..... 137/268
6,394,184 B2 5/2002 Tolman et al. ..... 166/281
6,400,646 B1 6/2002 Shah et al. ..... 367/82
6,429,784 B1 8/2002 Beique et al. ..... 340/853.2
6,462,672 B1 10/2002 Besson ..... 340/853.2
6,543,538 B2 4/2003 Tolman et al. ..... 166/284
6,670,880 B1 12/2003 Hall et al. ..... 336/132
6,679,332 B2 1/2004 Vinegar et al. ..... 166/373
6,695,277 B1 2/2004 Gallis ..... 241/191
6,702,019 B2 3/2004 Dusterhoft et al. ..... 166/278
6,717,501 B2 4/2004 Hall et al. ..... 336/132
6,727,827 B1 4/2004 Edwards et al. ..... 340/854.9
6,745,012 B1 6/2004 Dao et al.
6,772,837 B2 8/2004 Dusterhoft et al. ..... 166/278
6,816,082 B1 11/2004 Laborde ..... 340/853.3
6,868,037 B2 3/2005 Dasgupta et al. ..... 367/54
6,880,634 B2 4/2005 Gardner et al. ..... 166/250.01
6,883,608 B2 4/2005 Parlar et al. ..... 166/278
6,899,178 B2 5/2005 Tubel ..... 166/313
6,909,667 B2 6/2005 Shah et al. ..... 367/83
6,912,177 B2 6/2005 Smith ..... 367/82
6,920,085 B2 7/2005 Finke et al. ..... 367/83
6,930,616 B2 8/2005 Tang et al. ..... 340/854.4
6,940,392 B2 9/2005 Chan et al. ..... 340/10.4
6,940,420 B2 9/2005 Jenkins ..... 340/855.6
6,953,094 B2 10/2005 Ross et al. ..... 166/381
6,956,791 B2 10/2005 Dopf et al. ..... 367/82
6,980,929 B2 12/2005 Aronstam et al. ..... 702/188
6,987,463 B2 1/2006 Beique et al. ..... 340/856.3
7,006,918 B2 2/2006 Economides et al. ..... 702/1
7,011,157 B2 3/2006 Costley et al. ..... 166/311
7,036,601 B2 5/2006 Berg et al. ..... 166/385
7,051,812 B2 5/2006 McKee et al. ..... 166/305.1
7,064,676 B2 6/2006 Hall et al. ..... 350/853.1
7,082,993 B2 8/2006 Ayoub et al. ..... 166/250.1
7,090,020 B2 8/2006 Hill et al. ..... 166/373
7,140,434 B2 11/2006 Chouzenoux et al. .. 166/250.11
7,219,762 B2 5/2007 James et al. ..... 181/105
7,224,288 B2 5/2007 Hall et al. ..... 340/853.7
7,228,902 B2 6/2007 Oppelt ..... 166/250.02
7,249,636 B2 7/2007 Ohmer ..... 166/383
7,252,152 B2 8/2007 LoGiudice et al. ..... 166/386
7,257,050 B2 8/2007 Stewart et al. ..... 367/82
7,261,154 B2 8/2007 Hall et al. ..... 166/242.2
7,261,162 B2 8/2007 Deans et al. ..... 166/336
7,275,597 B2 10/2007 Hall et al. ..... 166/297
7,277,026 B2 10/2007 Hall et al. ..... 340/854.8
RE40,032 E 1/2008 van Borkhorst et al. . 455/343.2
7,317,990 B2 1/2008 Sinha et al. ..... 702/6
7,321,788 B2 1/2008 Addy et al. ..... 455/574
7,322,416 B2 1/2008 Burris, II et al. ..... 166/308.1
7,325,605 B2 2/2008 Fripp et al. ..... 166/250.01
7,339,494 B2 3/2008 Shah et al. ..... 340/855.7
7,348,893 B2 3/2008 Huang et al. ..... 340/854.3
7,385,523 B2 6/2008 Thomeer et al. ..... 340/854.8
7,387,165 B2 6/2008 Lopez de Cardenas et al. ..... 166/313
7,411,517 B2 8/2008 Flanagan ..... 340/854.4
7,477,160 B2 1/2009 Lemenager et al. ..... 340/853.1
7,516,792 B2 4/2009 Lonnes et al. ..... 166/308.1
7,551,057 B2 6/2009 King et al. ..... 340/5.72
7,590,029 B2 9/2009 Tingley ..... 367/82
7,595,737 B2 9/2009 Fink et al. ..... 340/854.4
7,602,668 B2 10/2009 Liang et al. ..... 367/25
7,649,473 B2 1/2010 Johnson et al. ..... 340/853.1
7,750,808 B2 7/2010 Masino et al. ..... 340/572.1
7,775,279 B2 8/2010 Marya et al. ..... 166/297
7,787,327 B2 8/2010 Tang et al. ..... 367/27
7,819,188 B2 10/2010 Auzerais et al. ..... 155/250
7,828,079 B2 11/2010 Oothoudt ..... 175/20
7,831,283 B2 11/2010 Ogushi et al. ..... 455/574
7,913,773 B2 3/2011 Li et al. ..... 175/40
7,952,487 B2 5/2011 Montebovi ..... 340/636.1
7,994,932 B2 8/2011 Huang et al. ..... 340/854.3
8,004,421 B2 8/2011 Clark ..... 340/854.4
8,044,821 B2 10/2011 Mehta ..... 340/855.7
8,049,506 B2 11/2011 Lazarev ..... 324/333
8,115,651 B2 2/2012 Camwell et al. ..... 340/853.2
8,117,907 B2 2/2012 Han et al. ..... 73/152.58
8,157,008 B2 4/2012 Lilley ..... 166/253.1
8,162,050 B2 4/2012 Roddy et al. ..... 166/253.1
8,220,542 B2 7/2012 Whitsitt et al. ..... 166/278
8,237,585 B2 8/2012 Zimmerman ..... 340/854.6
8,242,928 B2 8/2012 Prammer ..... 340/853.7
8,276,674 B2 10/2012 Lopez de Cardenas et al. ..... 166/373
8,284,075 B2 10/2012 Fincher et al. ..... 340/854.4
8,284,947 B2 10/2012 Giesbrecht et al. ..... 381/66
8,316,936 B2 11/2012 Roddy et al. ..... 166/253.1
8,330,617 B2 12/2012 Chen et al. ..... 340/854.6
8,347,982 B2 1/2013 Hannegan et al. ..... 175/5
8,358,220 B2 1/2013 Savage ..... 340/853.1

(56) References Cited

U.S. PATENT DOCUMENTS 8,376,065 B2 2/2013 Teodorescu et al. ..... 175/40
8,381,822 B2 2/2013 Hales et al. ..... 166/377
8,388,899 B2 3/2013 Mitani et al. ..... 422/179
8,411,530 B2 4/2013 Slocum et al. ..... 367/90
8,434,354 B2 5/2013 Crow et al. ..... 73/152.04
8,494,070 B2 7/2013 Luo et al. ..... 375/262
8,496,055 B2 7/2013 Mootoo et al. ..... 166/278
8,539,890 B2 9/2013 Tripp et al. ..... 109/25
8,544,564 B2 10/2013 Moore et al. ..... 175/50
8,552,597 B2 10/2013 Song et al. ..... 307/149
8,556,302 B2 10/2013 Dole ..... 285/367
8,559,272 B2 10/2013 Wang
8,596,359 B2 12/2013 Grigsby et al. ..... 166/278
8,605,548 B2 12/2013 Froelich ..... 367/82
8,607,864 B2 12/2013 Mcleod et al. ..... 166/250.1
8,664,958 B2 3/2014 Simon ..... 324/338
8,672,875 B2 3/2014 Vanderveen et al. ..... 604/67
8,675,779 B2 3/2014 Zeppetelle et al. ..... 375/340
8,683,859 B2 4/2014 Godager ..... 73/152.54
8,689,621 B2 4/2014 Godager ..... 73/152.54
8,701,480 B2 4/2014 Eriksen ..... 73/152.51
8,750,789 B2 6/2014 Baldemair et al. ..... 455/11.1
8,787,840 B2 7/2014 Srinivasan et al. ..... 455/69
8,805,632 B2 8/2014 Coman et al. ..... 702/89
8,826,980 B2 9/2014 Neer ..... 166/255.1
8,833,469 B2 9/2014 Purkis ..... 166/373
8,893,784 B2 11/2014 Abad ..... E21B 43/26
8,910,716 B2 12/2014 Newton et al. ..... 166/373
8,994,550 B2 3/2015 Millot et al. ..... E21B 47/16
8,995,837 B2 3/2015 Mizuguchi et al. ... H04B 10/27
9,062,508 B2 6/2015 Huval et al. ..... E21B 47/122
9,062,531 B2 6/2015 Jones ..... E21B 47/082
9,075,155 B2 7/2015 Luscombe et al. .... G01V 1/226
9,078,055 B2 7/2015 Nguyen et al. ..... G01V 1/226
9,091,153 B2 7/2015 Yang et al. ..... E21B 47/12
9,133,705 B2 9/2015 Angeles Boza ..... E21B 47/12
9,140,097 B2 9/2015 Themig et al. ..... E21B 34/12
9,144,894 B2 9/2015 Barnett et al. ..... B25B 17/00
9,206,645 B2 12/2015 Hallundbaek ..... E21B 7/04
9,279,301 B2 3/2016 Lovorn et al. ..... E21B 21/103
9,284,819 B2 3/2016 Tolman et al. ..... E21B 41/00
9,284,834 B2 3/2016 Alteirac et al. ..... E21B 47/12
9,310,510 B2 4/2016 Godager ..... G01V 3/38
9,333,350 B2 5/2016 Rise et al. ..... A61N 1/36082
9,334,696 B2 5/2016 Hay ..... E21B 47/12
9,359,841 B2 6/2016 Hall ..... E21B 23/00
9,363,605 B2 6/2016 Goodman et al. ..... H04R 17/00
9,376,908 B2 6/2016 Ludwig et al. ..... E21B 47/01
9,441,470 B2 9/2016 Guerrero et al. ..... E21B 43/14
9,515,748 B2 12/2016 Jeong et al. ..... G01L 25/90
9,557,434 B2 1/2017 Keller et al. ..... G01V 1/52
9,617,829 B2 4/2017 Dale et al. ..... E21B 41/00
9,617,850 B2 4/2017 Fripp et al. ..... E21B 47/18
9,631,485 B2 4/2017 Keller et al. ..... E21B 47/16
9,657,564 B2 5/2017 Stolpman ..... E21B 47/16
9,664,037 B2 5/2017 Logan et al. ..... E21B 47/122
9,670,773 B2 6/2017 Croux ..... E21B 47/16
9,683,434 B2 6/2017 Machocki ..... E21B 44/00
9,686,021 B2 6/2017 Merino ..... E21B 47/16
9,715,031 B2 7/2017 Contant et al. ..... E21B 47/122
9,721,448 B2 8/2017 Wu et al. ..... G08B 21/20
9,759,062 B2 9/2017 Deffenbaugh et al. ..... E21B 47/16
9,816,373 B2 11/2017 Howell et al. ..... E21B 47/16
9,822,634 B2 11/2017 Gao ..... E21B 47/16
9,863,222 B2 1/2018 Morrow et al. ..... E21B 43/122
9,879,525 B2 1/2018 Morrow et al. ..... E21B 47/12
9,945,204 B2 4/2018 Ross et al. ..... E21B 33/127
9,963,955 B2 5/2018 Tolman et al. ..... E21B 43/119
10,100,635 B2 10/2018 Keller et al. ..... E21B 47/18
10,103,846 B2 10/2018 van Zelm et al. ..... E21B 47/12
10,132,149 B2 11/2018 Morrow et al. ..... E21B 43/267
10,145,228 B2 12/2018 Yarus et al. ..... E21B 44/00
10,167,716 B2 1/2019 Clawson et al. ..... E21B 47/14
10,167,717 B2 1/2019 Deffenbaugh et al. ..... E21B 47/16
10,190,410 B2 1/2019 Clawson et al. ..... E21B 47/14
10,196,862 B2 2/2019 Li-Leger et al. ..... E21B 17/02
2002/0180613 A1 12/2002 Shi et al. ..... E21B 47/18
2002/0196743 A1 12/2002 Sebastian et al.
2003/0056953 A1 3/2003 Tumlin et al. ..... 166/298
2003/0067940 A1 4/2003 Edholm
2003/0117896 A1 6/2003 Sakuma et al. ..... 367/81
2004/0020063 A1 2/2004 Lewis et al. ..... 33/313
2004/0055746 A1* 3/2004 Ross ..... B23K 3/0623 166/250.15
2004/0200613 A1 10/2004 Fripp et al. ..... 166/250.01
2004/0239521 A1* 12/2004 Zierolf ..... E21B 17/006 340/854.1
2005/0241824 A1* 11/2005 Burris, II ..... E21B 23/10 166/255.1
2005/0269083 A1 12/2005 Burris et al. ..... 166/255.2
2005/0284659 A1 12/2005 Hall et al. ..... 175/27
2006/0033638 A1 2/2006 Hall et al. ..... 340/854.6
2006/0041795 A1 2/2006 Gabelmann et al. ..... 714/699
2006/0090893 A1 5/2006 Sheffield ..... 166/250.15
2006/0187755 A1 8/2006 Tingley ..... 367/82
2007/0139217 A1 6/2007 Beique et al. ..... 340/856.3
2007/0146351 A1 6/2007 Katsurahira et al. ..... 345/179
2007/0156359 A1 7/2007 Varsamis et al. ..... 702/69
2007/0219758 A1 9/2007 Bloomfield ..... 702/190
2007/0272411 A1 11/2007 Lopez de Cardenas et al. ..... 166/305.1
2008/0030365 A1 2/2008 Fripp et al. ..... E21B 47/16
2008/0110644 A1 5/2008 Howell et al. ..... 166/387
2008/0185144 A1 8/2008 Lovell ..... 166/250.17
2008/0304360 A1 12/2008 Mozer ..... 367/117
2009/0003133 A1 1/2009 Dalton et al. ..... 367/82
2009/0030614 A1 1/2009 Carnegie et al. ..... 702/6
2009/0034368 A1 2/2009 Johnson ..... 367/83
2009/0045974 A1 2/2009 Patel ..... 340/854.6
2009/0080291 A1 3/2009 Tubel et al. ..... 367/81
2009/0166031 A1 7/2009 Hernandez ..... 166/250.01
2010/0013663 A1 1/2010 Cavender et al. ..... 340/854.3
2010/0089141 A1 4/2010 Rioufol et al. ..... 13/152.28
2010/0112631 A1 5/2010 Hur et al. ..... 435/39
2010/0133004 A1 6/2010 Burleson et al. ..... 175/2
2010/0182161 A1 7/2010 Robbins et al. ..... 340/853.7
2010/0212891 A1 8/2010 Stewart et al. ..... 166/250.12
2011/0056692 A1* 3/2011 Lopez de Cardenas ..... E21B 43/26 166/305.1
2011/0061862 A1 3/2011 Loretz et al. ..... 166/250.11
2011/0066378 A1 3/2011 Lerche et al. ..... 702/6
2011/0168403 A1 7/2011 Patel ..... 166/373
2011/0188345 A1 8/2011 Wang ..... 367/34
2011/0297376 A1 12/2011 Holderman et al. ..... 166/278
2011/0297673 A1 12/2011 Zbat et al. ..... 219/756
2011/0301439 A1 12/2011 Albert et al. ..... 600/301
2011/0315377 A1 12/2011 Rioufol ..... 166/250.17
2012/0043079 A1 2/2012 Wassouf et al. ..... 166/250
2012/0126992 A1 5/2012 Rodney et al. ..... 340/850
2012/0152562 A1 6/2012 Newton et al. ..... 166/369
2012/0179377 A1 7/2012 Lie ..... 702/6
2012/0268074 A1* 10/2012 Cooley ..... H02J 7/007 320/130
2013/0000981 A1 1/2013 Grimmer et al. ..... 175/45
2013/0003503 A1 1/2013 L'Her et al. ..... 367/106
2013/0062055 A1* 3/2013 Tolman ..... E21B 43/119 166/250.01
2013/0106615 A1 5/2013 Prammer ..... 340/854.6
2013/0138254 A1 5/2013 Seals et al. ..... 700/282
2013/0168083 A1* 7/2013 McCarter ..... E21B 23/00 166/250.01
2013/0186645 A1* 7/2013 Hall ..... E21B 47/12 166/382
2013/0192823 A1 8/2013 Barrilleaux et al. ..... 166/250.01
2013/0278432 A1 10/2013 Shashoua et al. ..... 340/853.7
2013/0319102 A1 12/2013 Riggenberg et al. ..... 13/152.28
2014/0060840 A1 3/2014 Hartshorne et al. ..... 166/300
2014/0062715 A1 3/2014 Clark ..... 340/853.2
2014/0102708 A1 4/2014 Purkis et al. ..... 166/308.1

(56) References Cited

U.S. PATENT DOCUMENTS

| | | | | |
|---|---|---|---|---|
| 2014/0133276 | A1 | 5/2014 | Volker et al. | 367/82 |
| 2014/0152659 | A1 | 6/2014 | Davidson et al. | 345/420 |
| 2014/0153368 | A1 | 6/2014 | Bar-Cohen et al. | 367/81 |
| 2014/0166266 | A1 | 6/2014 | Read | 166/250.01 |
| 2014/0170025 | A1 | 6/2014 | Weiner et al. | 422/82.01 |
| 2014/0266769 | A1 | 9/2014 | van Zelm | 340/854.3 |
| 2014/0327552 | A1 | 11/2014 | Filas et al. | 340/854.6 |
| 2014/0352955 | A1 | 12/2014 | Tubel et al. | 166/250.15 |
| 2015/0003202 | A1 | 1/2015 | Palmer et al. | 367/82 |
| 2015/0009040 | A1 | 1/2015 | Bowles et al. | 340/854.6 |
| 2015/0027687 | A1 | 1/2015 | Tubel | 166/72 |
| 2015/0041124 | A1 | 2/2015 | Rodriguez | 166/255.1 |
| 2015/0041137 | A1 | 2/2015 | Rodriguez | 166/301 |
| 2015/0152727 | A1 | 6/2015 | Fripp et al. | E21B 47/14 |
| 2015/0159481 | A1 | 6/2015 | Mebarkia et al. | E21B 47/065 |
| 2015/0167425 | A1 | 6/2015 | Hammer et al. | E21B 34/06 |
| 2015/0176370 | A1 | 6/2015 | Greening et al. | E21B 41/00 |
| 2015/0292319 | A1 | 10/2015 | Disko et al. | E21B 47/16 |
| 2015/0292320 | A1 | 10/2015 | Lynk et al. | E21B 47/16 |
| 2015/0300159 | A1 | 10/2015 | Stiles et al. | E21B 47/16 |
| 2015/0330200 | A1 | 11/2015 | Richard et al. | E21B 44/00 |
| 2015/0337642 | A1 | 11/2015 | Spacek | E21B 44/005 |
| 2015/0354351 | A1 | 12/2015 | Morrow et al. | E21B 47/16 |
| 2015/0377016 | A1 | 12/2015 | Ahmad | E21B 47/122 |
| 2016/0010446 | A1 | 1/2016 | Logan et al. | E21B 47/122 |
| 2016/0010447 | A1* | 1/2016 | Merino | E21B 34/06 340/854.6 |
| 2016/0047230 | A1 | 2/2016 | Livescu et al. | E21B 47/10 |
| 2016/0047233 | A1 | 2/2016 | Butner et al. | E21B 47/12 |
| 2016/0076363 | A1 | 3/2016 | Morrow et al. | E21B 47/12 |
| 2016/0109606 | A1 | 4/2016 | Market et al. | G01B 1/50 |
| 2016/0215612 | A1 | 7/2016 | Morrow | E21B 47/122 |
| 2017/0138185 | A1 | 5/2017 | Saed et al. | E21B 47/16 |
| 2017/0145811 | A1 | 5/2017 | Robison et al. | E21B 47/0007 |
| 2017/0152741 | A1 | 6/2017 | Park et al. | E21B 47/123 |
| 2017/0167249 | A1 | 6/2017 | Lee et al. | E21B 47/14 |
| 2017/0204719 | A1 | 7/2017 | Babakhani | E21B 47/0005 |
| 2017/0254183 | A1 | 9/2017 | Vasques et al. | E21B 47/16 |
| 2017/0293044 | A1 | 10/2017 | Gilstrap et al. | G01V 1/50 |
| 2017/0314386 | A1 | 11/2017 | Orban et al. | E21B 47/091 |
| 2018/0010449 | A1 | 1/2018 | Roberson et al. | E21B 47/16 |
| 2018/0058191 | A1 | 3/2018 | Romer et al. | E21B 47/0007 |
| 2018/0058198 | A1 | 3/2018 | Ertas et al. | E21B 47/12 |
| 2018/0058202 | A1 | 3/2018 | Disko et al. | E21B 47/14 |
| 2018/0058203 | A1 | 3/2018 | Clawson et al. | E21B 47/14 |
| 2018/0058204 | A1 | 3/2018 | Clawson et al. | E21B 47/14 |
| 2018/0058205 | A1 | 3/2018 | Clawson et al. | E21B 47/14 |
| 2018/0058206 | A1 | 3/2018 | Zhang et al. | E21B 47/16 |
| 2018/0058207 | A1 | 3/2018 | Song et al. | E21B 47/16 |
| 2018/0058208 | A1 | 3/2018 | Song et al. | E21B 47/16 |
| 2018/0058209 | A1 | 3/2018 | Song et al. | E21B 47/16 |
| 2018/0066490 | A1 | 3/2018 | Kjos | E21B 33/035 |
| 2018/0066510 | A1 | 3/2018 | Walker et al. | E21B 47/011 |
| 2019/0112913 | A1 | 4/2019 | Song et al. | E21B 47/01 |
| 2019/0112915 | A1 | 4/2019 | Disko et al. | E21B 47/14 |
| 2019/0112916 | A1 | 4/2019 | Song et al. | E21B 47/14 |
| 2019/0112917 | A1 | 4/2019 | Disko et al. | E21B 47/14 |
| 2019/0112918 | A1 | 4/2019 | Yi et al. | E21B 4/16 |
| 2019/0112919 | A1 | 4/2019 | Song et al. | E21B 47/16 |
| 2019/0116085 | A1 | 4/2019 | Zhang et al. | H04L 12/24 |
| 2019/0153857 | A1 | 5/2019 | Yi et al. | |
| 2019/0153858 | A1 | 5/2019 | Kinn et al. | |
| 2019/0154859 | A1 | 5/2019 | Song et al. | |
| 2019/0203574 | A1 | 7/2019 | Yi et al. | |
| 2019/0203591 | A1 | 7/2019 | Disko et al. | |
| 2019/0242249 | A1 | 8/2019 | Walker et al. | |
| 2019/0249548 | A1 | 8/2019 | Zhang et al. | |

FOREIGN PATENT DOCUMENTS

| | | | |
|---|---|---|---|
| EP | 1409839 | 4/2005 | E21B 43/1185 |
| EP | 2677698 | 12/2013 | H04L 12/28 |
| WO | WO2001/033391 | 1/2001 | |
| WO | WO2002/027139 | 4/2002 | E21B 43/12 |
| WO | WO2004/033852 | 4/2004 | |
| WO | WO2010/074766 | 7/2010 | A41C 1/14 |
| WO | WO2013/079928 | 6/2013 | E21B 47/12 |
| WO | WO2013/162506 | 10/2013 | |
| WO | WO2014/018010 | 1/2014 | E21B 47/12 |
| WO | WO2014/049360 | 4/2014 | E21B 47/12 |
| WO | WO2014/100271 | 6/2014 | E21B 47/12 |
| WO | WO2014/134741 | 9/2014 | E21B 47/13 |
| WO | WO2015/117060 | 8/2015 | E21B 47/12 |

OTHER PUBLICATIONS

U.S. Appl. No. 62/782,153, filed Dec. 19, 2019, Yi, Xiaohua et al.

U.S. Appl. No. 62/782,160, filed Dec. 19, 2018, Hall, Timothy J. et al.

Arroyo, Javier et al. (2009) "Forecasting Histogram Time Series with K-Nearest Neighbours Methods," *International Journal of Forecasting*, v.25, pp. 192-207.

Arroyo, Javier et al. (2011) "Smoothing Methods for Histogram-Valued Time Seriers: An Application to Value-at-Risk," *Univ. of California, Dept. of Economics*, www.wileyonlinelibrary.com, Mar. 8, 2011, 28 pages.

Arroyo, Javier et al. (2011) "Forecasting with Interval and Histogram Data Some Financial Applications," *Univ. of California, Dept. of Economics*, 46 pages.

Emerson Process Management (2011), "Roxar downhole Wireless PT sensor system," www.roxar.com, or downhole@roxar.com, 2 pgs.

Gonzalez-Rivera, Gloria et al. (2012) "Time Series Modeling of Histogram-Valued Data: The Daily Histogram Time Series of S&P500 Intradaily Returns," *International Journal of Forecasting*, v.28, 36 pgs.

Gutierrez-Estevez, M. A. et al. (2013) "Acoustic Boardband Communications Over Deep Drill Strings using Adaptive OFDM", *IEEE Wireless Comm. & Networking Conf.*, pp. 4089-4094.

Qu, X. et al. (2011) "Reconstruction fo Self-Sparse 20 NMR Spectra From undersampled Data In The Indirect Dimension", pp. 8888-8909.

U.S. Department of Defense (1999) "Interoperability and Performance Standards for Medium and High Frequency Radio Systems," MIL-STD-188-141B, Mar. 1, 1999, 584 pages.

* cited by examiner

DISCRETE WELLBORE DEVICES, HYDROCARBON WELLS INCLUDING A DOWNHOLE COMMUNICATION NETWORK AND THE DISCRETE WELLBORE DEVICES AND SYSTEMS AND METHODS INCLUDING THE SAME

CROSS-REFERENCE TO RELATED APPLICATION

This application is a divisional of U.S. patent application Ser. No. 14/820,616 filed Aug. 7, 2015, which claims the priority benefit of U.S. Patent Application 62/049,513 filed Sep. 12, 2014 entitled "Discrete Wellbore Devices, Hydrocarbon Wells Including A Downhole Communication Network And The Discrete Wellbore Devices and Systems and Methods Including The Same," the entirety of which is incorporated by reference herein.

FIELD OF THE DISCLOSURE

The present disclosure is directed to discrete wellbore devices, to hydrocarbon wells that include both a downhole communication network and the discrete wellbore devices, as well as to systems and methods that include the downhole communication network and/or the discrete wellbore device.

BACKGROUND OF THE DISCLOSURE

An autonomous wellbore tool may be utilized to perform one or more downhole operations within a wellbore conduit that may be defined by a wellbore tubular and/or that may extend within a subterranean formation. Generally, the autonomous wellbore tool is pre-programmed within a surface region, such as by direct, or physical, attachment to a programming device, such as a computer. Subsequently, the autonomous wellbore tool may be released into the wellbore conduit and may be conveyed autonomously therein. A built-in controller, which forms a portion of the autonomous wellbore tool, may retain program information from the pre-programming process and may utilize this program information to control the operation of the autonomous wellbore tool. This may include controlling actuation of the autonomous wellbore tool when one or more actuation criteria are met.

With traditional autonomous wellbore tools, an operator cannot modify and/or change programming once the autonomous wellbore tool has been released within the wellbore conduit. In addition, the operator also may not receive any form of direct communication to indicate that the autonomous wellbore tool has executed the downhole operation. Thus, there exists a need for discrete wellbore devices that are configured to communicate wirelessly, for hydrocarbon wells including a wireless communication network and the discrete wellbore devices, and for systems and methods including the same.

SUMMARY OF THE DISCLOSURE

Discrete wellbore devices, hydrocarbon wells including a downhole communication network and the discrete wellbore devices, and systems and methods including the same are disclosed herein. The discrete wellbore devices include a wellbore tool and a communication device. The wellbore tool is configured to perform a downhole operation within a wellbore conduit that is defined by a wellbore tubular of the hydrocarbon well. The communication device is operatively coupled for movement with the wellbore tool within the wellbore conduit. The communication device is configured to communicate, via a wireless communication signal, with a downhole communication network that extends along the wellbore tubular.

The hydrocarbon wells include a wellbore that extends within a subterranean formation. The hydrocarbon wells further include the wellbore tubular, and the wellbore tubular extends within the wellbore. The hydrocarbon wells also include the downhole communication network, and the downhole communication network is configured to transfer a data signal along the wellbore conduit and/or to a surface region. The hydrocarbon wells further include the discrete wellbore device, and the discrete wellbore device is located within a downhole portion of the wellbore conduit.

The methods may include actively and/or passively detecting a location of the discrete wellbore device within the wellbore conduit. These methods include conveying the discrete wellbore device within the wellbore conduit and wirelessly detecting proximity of the discrete wellbore device to a node of the downhole communication network. These methods further include generating a location indication signal with the node responsive to detecting proximity of the discrete wellbore device to the node. These methods also include transferring the location indication signal to the surface region with the downhole communication network.

The methods additionally or alternatively may include wireless communication between the discrete wellbore device and the downhole communication network. The communication may include transmitting data signals from the discrete wellbore device. The communication may include transmitting commands and/or programming to the discrete wellbore device. These methods include conveying the discrete wellbore device within the wellbore conduit and transmitting the wireless communication signal between the discrete wellbore device and a given node of the downhole communication network and/or another discrete wellbore device within the wellbore.

DETAILED DESCRIPTION AND BEST MODE OF THE DISCLOSURE

Figure 1:
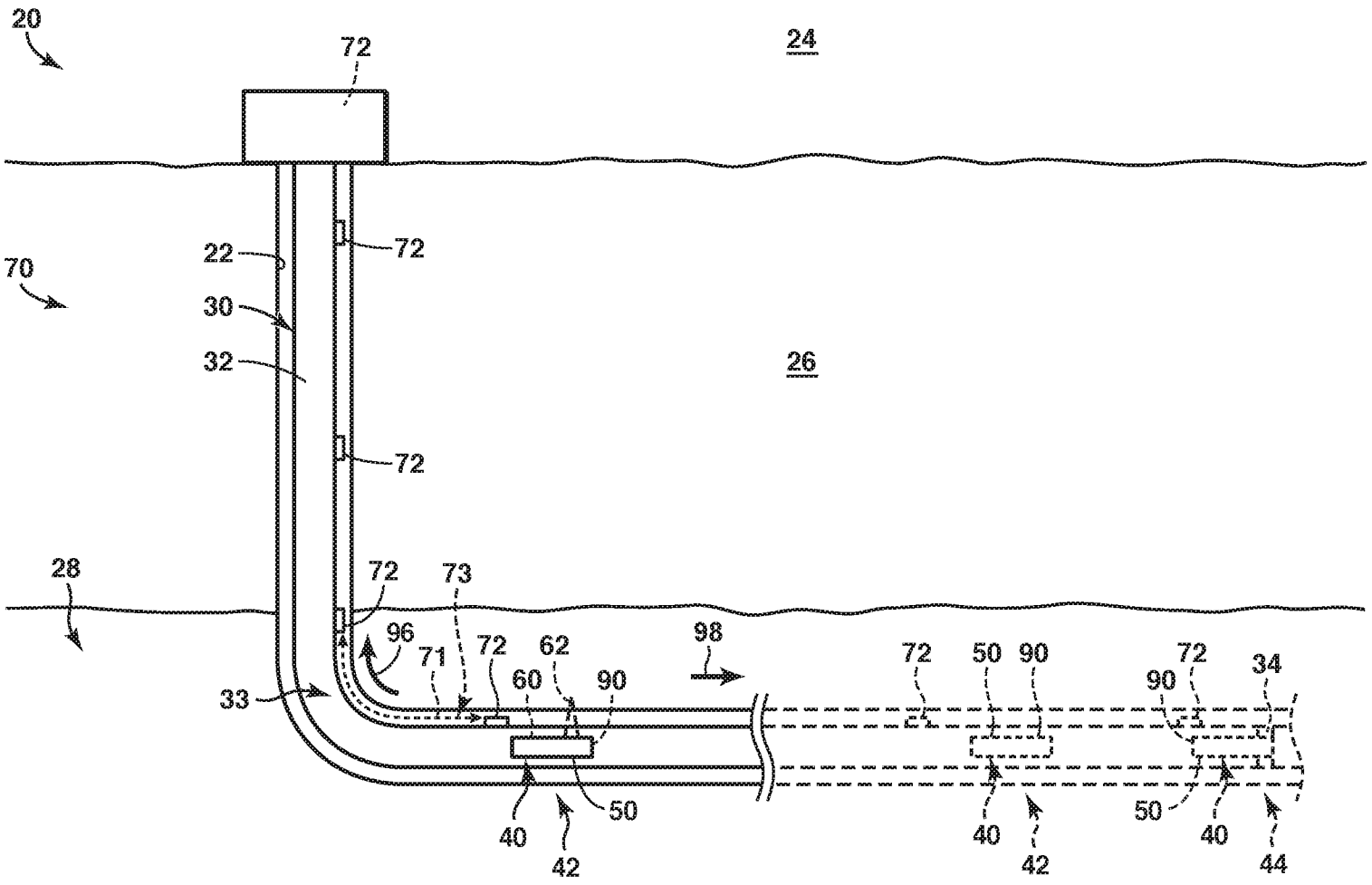
FIG. 1 is a schematic representation of a hydrocarbon well that may include and/or utilize the systems, discrete wellbore devices, and methods according to the present disclosure.

FIGS. 1-4 provide examples of discrete wellbore devices 40 according to the present disclosure, of hydrocarbon wells 20 and/or wellbore conduits 32 that include, contain, and/or utilize discrete wellbore devices 40, of methods 100, according to the present disclosure, of determining a location of discrete wellbore devices 40 within wellbore conduit 32, and/or of methods 200, according to the present disclosure, of operating discrete wellbore devices 40. Elements that serve a similar, or at least substantially similar, purpose are labeled with like numbers in each of FIGS. 1-4, and these elements may not be discussed in detail herein with reference to each of FIGS. 1-4. Similarly, all elements may not be labeled in each of FIGS. 1-4, but reference numerals associated therewith may be utilized herein for consistency. Elements, components, and/or features that are discussed herein with reference to one or more of FIGS. 1-4 may be included in and/or utilized with any of FIGS. 1-4 without departing from the scope of the present disclosure.

In general, elements that are likely to be included are illustrated in solid lines, while elements that are optional are illustrated in dashed lines. However, elements that are shown in solid lines may not be essential. Thus, an element shown in solid lines may be omitted without departing from the scope of the present disclosure.

Figure 2:
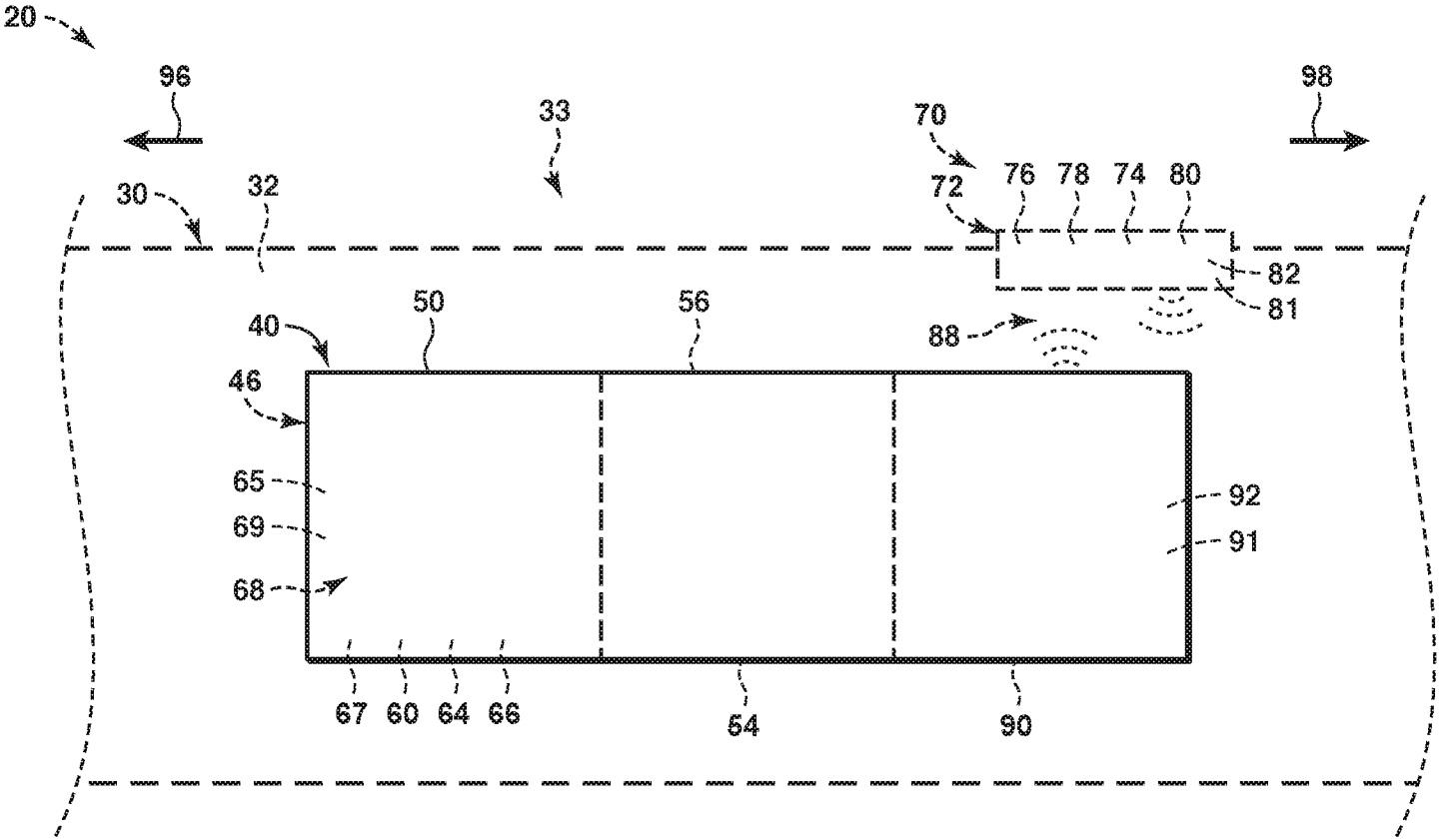
FIG. 2 is a schematic cross-sectional view of a discrete wellbore device, according to the present disclosure, that may be located within a wellbore conduit of a hydrocarbon well.

FIG. 1 is a schematic representation of a hydrocarbon well 20 that may include and/or utilize the systems and methods according to the present disclosure, while FIG. 2 is a schematic cross-sectional view of a discrete wellbore device 40, according to the present disclosure, that may be located within a wellbore conduit 32 of hydrocarbon well 20. As illustrated in FIG. 1, hydrocarbon well 20 includes a wellbore 22 that may extend within a subterranean formation 28 that may be present within a subsurface region 26. Additionally or alternatively, wellbore 22 may extend between a surface region 24 and subterranean formation 28. A wellbore tubular 30 extends within wellbore 22. The wellbore tubular defines wellbore conduit 32. Wellbore tubular 30 may include any suitable structure that may extend within wellbore 22 and/or that may define wellbore conduit 32. As examples, wellbore tubular 30 may include and/or be a casing string and/or tubing.

Hydrocarbon well 20 further includes a downhole communication network 70. Downhole communication network 70 includes a plurality of nodes 72 and is configured to transfer a data signal 71 along wellbore conduit 32, from surface region 24, to subsurface region 26, from surface region 24 to subterranean formation 28, and/or from subterranean formation 28 to surface region 24. Hydrocarbon well 20 also includes a discrete wellbore device 40, and the discrete wellbore device is located within a subterranean portion 33 of the wellbore conduit (i.e., a portion of wellbore conduit 32 that extends within subsurface region 26 and/or within subterranean formation 28).

As illustrated in FIG. 2, discrete wellbore device 40 includes a wellbore tool 50 and may include a control structure 54 and/or a communication device 90. Wellbore tool 50 is configured to perform a downhole operation within wellbore conduit 32. Communication device 90 may be operatively coupled and/or attached to wellbore tool 50 and may be configured for movement with wellbore tool 50 within the wellbore conduit. In addition, communication device 90 may be configured to communicate with downhole communication network 70 via a wireless communication signal 88 while discrete wellbore device 40 is being conveyed within the wellbore conduit.

Discrete wellbore device 40 may include and/or be an autonomous wellbore device that may be configured for autonomous, self-regulated, and/or self-controlled operation within wellbore conduit 32. Alternatively, discrete wellbore device 40 may be a remotely controlled wellbore device, and wireless communication signal 88 may be utilized to control at least a portion of the operation of the discrete wellbore device. Regardless of the exact configuration, discrete wellbore device 40 may be configured to be conveyed within wellbore conduit 32 in an untethered manner Stated another way, discrete wellbore device 40 may be uncoupled, or unattached, to surface region 24 while being conveyed within wellbore conduit 32 and/or when located within subterranean portion 33 of wellbore conduit 32. Stated yet another way, discrete wellbore device 40 may be free from physical contact, or connection, with surface region 24 and/or with a structure that is present within surface region 24 while being conveyed within wellbore conduit 32. Thus, discrete wellbore device 40 also may be referred to herein as an autonomous wellbore device 40, a disconnected wellbore device 40, a detached wellbore device 40, a free-flowing wellbore device 40, an independent wellbore device 40, a separate wellbore device 40, and/or a fluid-conveyed wellbore device 40.

Any structure(s) that form a portion of discrete wellbore device 40 may be operatively attached to one another and may be sized to be deployed within wellbore conduit 32 as a single, independent, and/or discrete, unit. Stated another way, discrete wellbore device 40 may include and/or be a unitary structure. Stated yet another way, discrete wellbore device 40 may include a housing 46 that may contain and/or house the structure(s) that form wellbore device 40. Examples of these structures include wellbore tool 50, communication device 90, control structure 54, and/or components thereof.

Wellbore tool 50 may include any suitable structure that may be adapted, configured, designed, and/or constructed to perform the downhole operation within wellbore conduit 32. As an example, wellbore tool 50 may include and/or be a perforation device 60 that is configured to form one or more perforations 62 (as illustrated in FIG. 1) within wellbore tubular 30. Under these conditions, the downhole operation may include perforation of the wellbore tubular.

As additional examples, wellbore tool 50 may include and/or be a plug 64 and/or a packer 66. Under these conditions, the downhole operation may include at least partial, or even complete, occlusion of the wellbore conduit by the plug and/or by the packer.

As yet another example, wellbore tool 50 may include and/or define an enclosed volume 68. The enclosed volume may contain a chemical 69, and the downhole operation may include release of the chemical into the wellbore conduit. Additionally or alternatively, the enclosed volume may contain a diversion agent 65, and the downhole operation may include release of the diversion agent into the wellbore conduit. Examples of diversion agent 65 include any suitable ball sealer, supplemental sealing material that is configured to seal a perforation within wellbore tubular 30, polylactic acid flakes, a chemical diversion agent, a self-degrading diversion agent, and/or a viscous gel.

As another example, wellbore tool 50 may include and/or be an orientation-regulating structure 67. The orientation-regulating structure may be configured to be conveyed with the wellbore tool within the wellbore conduit and to regulate a cross-sectional orientation of the wellbore tool within the wellbore conduit while the discrete wellbore device is being conveyed within the wellbore conduit. Under these conditions, the downhole operation may include regulation of the cross-sectional orientation of the wellbore tool.

Control structure 54, when present, may include any suitable structure that may be adapted, configured, designed, and/or constructed to be conveyed with the wellbore tool within the wellbore conduit. The control structure also may be adapted, configured, designed, constructed, and/or programmed to control the operation of at least a portion of the discrete wellbore device. This may include independent, autonomous, and/or discrete control of the discrete wellbore device.

As an example, control structure 54 may be programmed to determine that an actuation criterion has been satisfied. Responsive to the actuation criterion being satisfied, the control structure may provide an actuation signal to wellbore tool 50, and the wellbore tool may perform the downhole operation responsive to receipt of the actuation signal. The control structure then may be programmed to automatically generate (or control communication device 90 to generate) a wireless confirmation signal after performing the downhole operation. The wireless confirmation signal may confirm that the downhole operation was performed and may be conveyed to surface region 24 by downhole communication network 70.

The actuation criterion may include any suitable criterion. As an example, the actuation criterion may include receipt of a predetermined wireless communication signal from downhole communication network 70. As another example, discrete wellbore device 40 further may include a detector 56. Detector 56 may be adapted, configured, designed, and/or constructed to detect a downhole parameter and/or a parameter of the discrete wellbore device. Under these conditions, discrete wellbore device 40 may be configured to generate wireless communication signal 88, and the wireless communication signal may include, or be based upon, the downhole parameter and/or the parameter of the discrete wellbore device. Additionally or alternatively, the actuation criterion may include detecting the downhole parameter and/or the parameter of the discrete wellbore device, such as by determining that the downhole parameter and/or the parameter of the discrete wellbore device is outside a threshold, or predetermined, parameter range.

Communication device 90, when present, may include any suitable structure that is adapted, configured, designed, constructed, and/or programmed to communicate with downhole communication network 70 via wireless communication signal 88. As an example, communication device 90 may include a wireless device transmitter 91. The wireless device transmitter may be configured to generate wireless communication signal 88 and/or to convey the wireless communication signal to downhole communication network 70. As another example, communication device 90 additionally or alternatively may include a wireless device receiver 92. The wireless device receiver may be configured to receive the wireless communication signal from the downhole communication network and/or from another discrete wellbore device.

Wireless communication signal 88 may include and/or be any suitable wireless signal. As examples, the wireless communication signal may be an acoustic wave, a high frequency acoustic wave, a low frequency acoustic wave, a radio wave, an electromagnetic wave, light, an electric field, and/or a magnetic field.

During operation of hydrocarbon well 20, discrete wellbore device 40 may be located and/or placed within wellbore conduit 32 and subsequently may be conveyed within the wellbore conduit such that the discrete wellbore device is located within subterranean portion 33 of the wellbore conduit. This may include the discrete wellbore device being conveyed in an uphole direction 96 (i.e., toward surface region 24 and/or away from subterranean formation 28) and/or in a downhole direction 98 (i.e., toward subterranean formation 28 and/or away from surface region 24), as illustrated in FIG. 1.

As illustrated in dashed lines in FIG. 1, discrete wellbore device 40 may include and/or define a mobile conformation 42 and a seated conformation 44. Under these conditions, the downhole operation may include transitioning the discrete wellbore device from the mobile conformation to the seated conformation. When the discrete wellbore device is in mobile conformation 42, the discrete wellbore device may be adapted, configured, and/or sized to translate and/or otherwise be conveyed within wellbore conduit 32. When the discrete wellbore device is in seated conformation 44, the discrete wellbore device may be adapted, configured, and/or sized to be retained, or seated, at a target location within wellbore conduit 32. As an example, a fracture sleeve 34 may extend within (or define a portion of) wellbore conduit 32. When in the mobile conformation, the discrete wellbore device may be free to be conveyed past the fracture sleeve within the wellbore conduit. In contrast, and when in the seated conformation, the discrete wellbore device may be (or be sized to be) retained on the fracture sleeve.

While discrete wellbore device 40 is located within the wellbore conduit and/or within subterranean portion 33 thereof, the discrete wellbore device may wirelessly communicate with downhole communication network 70 and/or with one or more nodes 72 thereof. This wireless communication may be passive wireless communication or active wireless communication and may be utilized to permit and/or facilitate communication between discrete wellbore device 40 and surface region 24, to permit and/or facilitate communication between two or more discrete wellbore devices 40, to provide information about discrete wellbore device 40 to surface region 24, and/or to permit wireless control of the operation of discrete wellbore device 40 by an operator who may be located within surface region 24.

As used herein, the phrase "passive wireless communication" may be utilized to indicate that downhole communication network 70 is configured to passively detect and/or determine one or more properties of discrete wellbore device 40 without discrete wellbore device 40 including (or being required to include) an electronically controlled structure that is configured to emit a signal (wireless or otherwise) that is indicative of the one or more properties. As an example, downhole communication network 70 and/or one or more nodes 72 thereof may include a sensor 80 (as illustrated in FIG. 2) that may be configured to wirelessly detect proximity of discrete wellbore device 40 to a given node 72.

Under these conditions, sensor 80 may detect a parameter that is indicative of proximity of discrete wellbore device 40 to the given node 72. Examples of sensor 80 include an acoustic sensor that is configured to detect a sound that is indicative of proximity of discrete wellbore device 40 to the given node, a pressure sensor that is configured to detect a pressure (or pressure change) that is indicative of proximity of the discrete wellbore device to the given node, a vibration sensor that is configured to detect a vibration that is indicative of proximity of the discrete wellbore device to the given node, and/or an electric field sensor that is configured to detect an electric field that is indicative of proximity of the discrete wellbore device to the given node. Additional examples of sensor 80 include a magnetic field sensor that is configured to detect a magnetic field that is indicative of proximity of the discrete wellbore device to the given node, an electromagnetic sensor that is configured to detect an electromagnetic field that is indicative of proximity of the discrete wellbore device to the given node, a radio sensor that is configured to detect a radio wave signal that is indicative of proximity of the discrete wellbore device to the given node, and/or an optical sensor that is configured to detect an optical signal that is indicative of proximity of the discrete wellbore device to the given node.

As used herein, the phrase "active wireless communication" may be utilized to indicate electronically controlled wireless communication between discrete wellbore device 40 and downhole communication network 70. This active wireless communication may include one-way wireless communication or two-way wireless communication.

With one-way wireless communication, one of discrete wellbore device 40 and downhole communication network 70 may be configured to generate a wireless communication signal 88, and the other of discrete wellbore device 40 and downhole communication network 70 may be configured to receive the wireless communication signal. As an example, node 72 may include a wireless node transmitter 81 that is configured to generate wireless communication signal 88, and discrete wellbore device 40 may include wireless device receiver 92 that is configured to receive the wireless communication signal. As another example, discrete wellbore device 40 may include wireless device transmitter 91 that is configured to generate wireless communication signal 88, and node 72 may include a wireless node receiver 82 that is configured to receive the wireless communication signal.

With two-way wireless communication, discrete wellbore device 40 and downhole communication network 70 each may include respective wireless transmitters and respective wireless receivers. As an example, discrete wellbore device 40 may include both wireless device transmitter 91 and wireless device receiver 92. In addition, node 72 may include both wireless node transmitter 81 and wireless node receiver 82.

Returning to FIG. 1, the active and/or passive wireless communication between downhole communication network 70 and discrete wellbore device 40 may be utilized in a variety of ways. As an example, each node 72 may (passively or actively) detect proximity of discrete wellbore device 40 thereto and/or flow of discrete wellbore device 40 therepast. The node then may convey this information, via data signal 71, along wellbore conduit 32 and/or to surface region 24. Thus, downhole communication network 70 may be utilized to provide an operator of hydrocarbon well 20 with feedback information regarding a (at least approximate) location of discrete wellbore device 40 within wellbore conduit 32 as the discrete wellbore device is conveyed within the wellbore conduit.

As another example, downhole communication network 70 and/or nodes 72 thereof may be adapted, configured, and/or programmed to generate wireless data signal 88 (as illustrated in FIG. 2) that is indicative of a location and/or a depth of individual nodes 72 within subsurface region 26. This wireless data signal may be received by discrete wellbore device 40, and the discrete wellbore device may be adapted, configured, and/or programmed to perform one or more actions based upon the received location and/or depth.

As yet another example, discrete wellbore device 40 may be configured to perform the downhole operation within wellbore conduit 32. Under these conditions, it may be desirable to arm discrete wellbore device 40 once the discrete wellbore device reaches a threshold arming depth within subsurface region 26, and downhole communication network 70 may be configured to transmit a wireless arming signal to discrete wellbore device 40 responsive to the discrete wellbore device reaching the threshold arming depth. Downhole communication network 70 also may be configured to transmit a wireless actuation signal to discrete wellbore device 40 once the discrete wellbore device reaches a target region of the wellbore conduit. Responsive to receipt of the wireless actuation signal, discrete wellbore device 40 may perform the downhole operation within wellbore conduit 32. Downhole communication network 70 (or a node 72 thereof that is proximate perforation 62) may be configured to detect and/or determine that the downhole operation was performed (such as via detector 80 of FIG. 2) and may transmit a successful actuation signal via downhole communication network 70 and/or to surface region 24. Additionally or alternatively, downhole communication network 70 may be configured to detect and/or determine that discrete wellbore device 40 was unsuccessfully actuated (such as via detector 80) and may transmit an unsuccessful actuation signal via downhole communication network 70 and/or to surface region 24.

As another example, downhole communication network 70 may be configured to transmit a wireless query signal to discrete wellbore device 40. Responsive to receipt of the wireless query signal, discrete wellbore device 40 may be configured to generate and/or transmit a wireless status signal to downhole communication network 70. The wireless status signal may be received by downhole communication network 70 and/or a node 72 thereof. The wireless status signal may include information regarding a status of discrete wellbore device 40, an operational state of discrete wellbore device 40, a depth of discrete wellbore device 40 within the subterranean formation, a velocity of discrete wellbore device 40 within wellbore conduit 32, a battery power level of discrete wellbore device 40, a fault status of discrete wellbore device 40, and/or an arming status of discrete wellbore device 40. Downhole communication network 70 then may be configured to convey the information obtained from discrete wellbore device 40 along wellbore conduit 32 and/or to surface region 24 via data signal 71.

As yet another example, communication between discrete wellbore device 40 and downhole communication network 70 may be utilized to program, re-program, and/or control discrete wellbore device 40 in real-time, while discrete wellbore device 40 is present within wellbore conduit 32, and/or while discrete wellbore device 40 is being conveyed in the wellbore conduit. This may include transferring any suitable signal and/or command from surface region 24 to downhole communication network 70 as data signal 71, transferring the signal and/or command along wellbore conduit 32 via downhole communication network 70 and/or data signal 71 thereof, and/or wirelessly transmitting the signal and/or command from downhole communication network 70 (or a given node 72 thereof) to discrete wellbore device 40 (such as via wireless communication signal 88 of FIG. 2) as a wireless control signal.

As illustrated in dashed lines in FIG. 1, a plurality of discrete wellbore devices 40 may be located and/or present within wellbore conduit 32. When wellbore conduit 32 includes and/or contains the plurality of discrete wellbore devices 40, the discrete wellbore devices may be adapted, configured, and/or programmed to communicate with one another. For example, a first discrete wellbore device 40 may transmit a wireless communication signal directly to a second discrete wellbore device 40, with the second discrete wellbore device 40 receiving and/or acting upon information contained within the wireless communication signal. As another example, the first discrete wellbore device may transmit the wireless communication signal to downhole communication network 70, and downhole communication network 70 may convey the wireless communication signal to the second discrete wellbore device. This communication may permit the second discrete wellbore device to be programmed and/or re-programmed based upon information received from the first discrete wellbore device.

Downhole communication network 70 include any suitable structure that may be configured for wireless communication with discrete wellbore device 40 via wireless communication signals 88 (as illustrated in FIG. 2) and/or that may be configured to convey data signal 71 along wellbore conduit 32, to surface region 24 from subsurface region 26, and/or to subsurface region 26 from surface region 24. As an example, a plurality of nodes 72 may be spaced apart along wellbore conduit 32 (as illustrated in FIG. 1), and downhole communication network 70 may be configured to sequentially transmit data signal 71 among the plurality of nodes 72 and/or along wellbore conduit 32.

Transfer of data signal 71 between adjacent nodes 72 may be performed wirelessly, in which case downhole communication network 70 may be referred to herein as and/or may be a wireless downhole communication network 70. Under these conditions, data signal 71 may include and/or be an acoustic wave, a high frequency acoustic wave, a low frequency acoustic wave, a radio wave, an electromagnetic wave, light, an electric field, and/or a magnetic field. Additionally or alternatively, transfer of data signal 71 between adjacent nodes 72 may be performed in a wired fashion and/or via a data cable 73, in which case downhole communication network 70 may be referred to herein as and/or may be a wired downhole communication network 70. Under these conditions, data signal 71 may include and/or be an electrical signal.

As illustrated in FIG. 2, a given node 72 may include a data transmitter 76 that may be configured to generate the data signal and/or to provide the data signal to at least one other node 72. In addition, the given node 72 also may include a data receiver 78 that may be configured to receive the data signal from at least one other node 72. In general, the other nodes 72 may be adjacent to the given node 72, with one of the other nodes being located in uphole direction 96 from the given node and another of the other nodes being located in downhole direction 98 from the given node.

As discussed, nodes 72 also may include one or more sensors 80. Sensors 80 may be configured to detect a downhole parameter. Examples of the downhole parameter include a downhole temperature, a downhole pressure, a downhole fluid velocity, and/or a downhole fluid flow rate. Additional examples of the downhole parameter are discussed herein with reference to the parameters that are indicative of proximity of discrete wellbore device 40 to nodes 72 and/or that are indicative of the discrete wellbore device flowing past nodes 72 within wellbore conduit 32.

As also illustrated in FIG. 2, nodes 72 further may include a power source 74. Power source 74 may be configured to provide electrical power to one or more nodes 72. An example of power source 74 is a battery, which may be a rechargeable battery.

FIG. 2 schematically illustrates a node 72 as extending both inside and outside wellbore conduit 32, and it is within the scope of the present disclosure that nodes 72 may be located within hydrocarbon well 20 in any suitable manner. As an example, one or more nodes 72 of downhole communication network 70 may be operatively attached to an external surface of wellbore tubular 30. As another example, one or more nodes 72 of downhole communication network 70 may be operatively attached to an internal surface of wellbore tubular 30. As yet another example, one or more nodes 72 of downhole communication network 70 may extend through wellbore tubular 30, within wellbore tubular 30, and/or between the inner surface of the wellbore tubular and the outer surface of the wellbore tubular.

Figure 3:
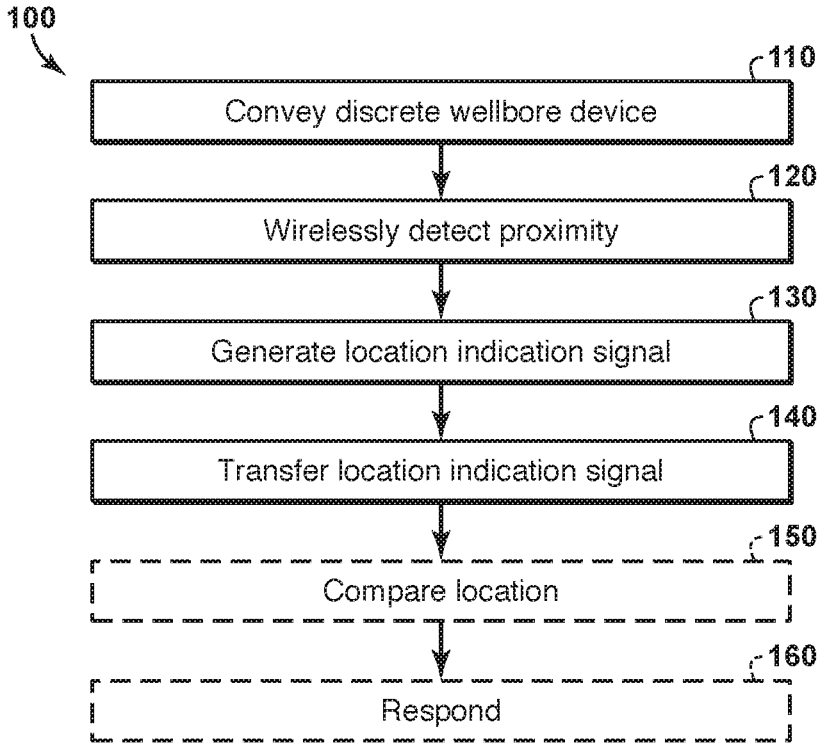
FIG. 3 is a flowchart depicting methods, according to the present disclosure, of determining a location of a discrete wellbore device within a wellbore conduit.

FIG. 3 is a flowchart depicting methods 100, according to the present disclosure, of determining a location of a discrete wellbore device within a wellbore conduit. Methods 100 include conveying the discrete wellbore device within the wellbore conduit at 110 and wirelessly detecting proximity of the discrete wellbore device to a node of a downhole communication network at 120. Methods 100 further include generating a location indication signal at 130 and transferring the location indication signal at 140. Methods 100 also may include comparing a calculated location of the discrete wellbore device to an actual location of the discrete wellbore device at 150 and/or responding to a location difference at 160.

Conveying the discrete wellbore device within the wellbore conduit at 110 may include translating the discrete wellbore device within the wellbore conduit in any suitable manner. As an example, the conveying at 110 may include translating the discrete wellbore device along at least a portion of a length of the wellbore conduit. As another example, the conveying at 110 may include conveying the discrete wellbore device from a surface region and into and/or within a subterranean formation. As another example, the conveying at 110 may include providing a fluid stream to the wellbore conduit and flowing the discrete wellbore device in, or within, the fluid stream. As yet another example, the conveying at 110 may include conveying under the influence of gravity.

Wirelessly detecting proximity of the discrete wellbore device to the node of the downhole communication network at 120 may include wirelessly detecting in any suitable manner. The downhole communication network may include a plurality of nodes that extends along the wellbore conduit, and the wirelessly detecting at 120 may include wirelessly detecting proximity of the discrete wellbore device to a specific, given, or individual, node.

The wirelessly detecting at 120 may be passive or active. When the wirelessly detecting is passive, the downhole communication network (or the node) may be configured to detect proximity of the discrete wellbore device thereto without the discrete wellbore device including (or being required to include) an electronically controlled structure that is configured to emit a wireless communication signal. As an example, the node may include a sensor that is configured to detect proximity of the discrete wellbore device thereto. Examples of the sensor are disclosed herein.

When the wirelessly detecting at 120 is active, the discrete wellbore device may include a wireless transmitter that is configured to generate the wireless communication signal. Under these conditions, the wirelessly detecting at 120 may include wirelessly detecting the wireless communication signal. Examples of the wireless communication signal are disclosed herein.

It is within the scope of the present disclosure that the wireless communication signal may be selected such that the wireless communication signal is only conveyed over a (relatively) short transmission distance within the wellbore conduit, such as a transmission distance of less than 5 meters, less than 2.5 meters, or less than 1 meter. Additional examples of the transmission distance are disclosed herein. Under these conditions, the plurality of nodes of the downhole communication network may be spaced apart a greater distance than the transmission distance of the wireless communication signal. As such, only a single node may detect the wireless communication signal at a given point in time and/or the single node may only detect the wireless communication signal when the discrete wellbore device is less than the transmission distance away from the given node.

Alternatively, the wireless communication signal may be selected such that the wireless communication signal is conveyed over a (relatively) larger transmission distance within the wellbore conduit, such as a transmission distance that may be greater than the spacing between nodes, or a node-to-node separation distance, of the downhole communication network. Under these conditions, two or more nodes of the downhole communication network may detect the wireless communication signal at a given point in time, and a signal strength of the wireless communication signal that is received by the two or more nodes may be utilized to determine, estimate, or calculate, the location of the discrete wellbore device within the wellbore conduit and/or proximity of the discrete wellbore device to a given node of the downhole communication network.

Examples of the node-to-node separation distance include node-to-node separation distances of at least 5 meters (m), at least 7.5 m, at least 10 m, at least 12.5 m, at least 15 m, at least 20 m, at least 25 m, at least 30 m, at least 40 m, at least 50 m, at least 75 m, or at least 100 m. Additionally or alternatively, the node-to-node separation distance may be less than 300 m, less than 200 m, less than 100 m, less than 50 m, less than 45 m, less than 40 m, less than 35 m, less than 30 m, less than 25 m, less than 20 m, less than 15 m, or less than 10 m.

The node-to-node separation distance also may be described relative to a length of the wellbore conduit. As examples, the node-to-node separation distance may be at least 0.1% of the length, at least 0.25% of the length, at least 0.5% of the length, at least 1% of the length, or at least 2% of the length. Additionally or alternatively, the node-to-node separation distance also may be less than 25% of the length, less than 20% of the length, less than 15% of the length, less than 10% of the length, less than 5% of the length, less than 2.5% of the length, or less than 1% of the length.

The discrete wellbore device also may be configured to generate a wireless location indication signal. The wireless location indication signal may be indicative of a calculated location of the discrete wellbore device within the wellbore conduit, with this calculated location being determined by the discrete wellbore device (or a control structure thereof). Under these conditions, the wirelessly detecting at 120 additionally or alternatively may include detecting the wireless location indication signal.

Generating the location indication signal at 130 may include generating the location indication signal with the node responsive to the wirelessly detecting at 120. As an example, the node may include a data transmitter that is configured to generate the location indication signal. Examples of the data transmitter and/or of the location indication signal are disclosed herein.

Transferring the location indication signal at 140 may include transferring the location indication signal from the node to the surface region with, via, and/or utilizing the downhole communication network. As an example, the transferring at 140 may include sequentially transferring the location indication signal along the wellbore conduit and to the surface region via the plurality of nodes. As another example, the transferring at 140 may include propagating the location indication signal from one node to the next within the downhole communication network. The propagation may be wired and/or wireless, as discussed herein.

Comparing the calculated location of the discrete wellbore device to the actual location of the discrete wellbore device at 150 may include comparing in any suitable manner. As an example, and as discussed, the wirelessly detecting at 120 may include wirelessly detecting a location indication signal that may be generated by the discrete wellbore device. As also discussed, this location indication signal may include the calculated location of the discrete wellbore device, as calculated by the discrete wellbore device. As another example, a location of each node of the downhole communication network may be (at least approximately) known and/or tabulated. As such, the actual location of the discrete wellbore device may be determined based upon knowledge of which node of the downhole communication network is receiving the location indication signal from the discrete wellbore device.

Responding to the location difference at 160 may include responding in any suitable manner and/or based upon any suitable criterion. As an example, the responding at 160 may include responding if the calculated location differs from the actual location by more than a location difference threshold. As another example, the responding at 160 may include re-programming the discrete wellbore device, such as based upon a difference between the calculated location and the actual location. As yet another example, the responding at 160 may include aborting the downhole operation. As another example, the responding at 160 may include calibrating the discrete wellbore device such that the calculated location corresponds to, is equal to, or is at least substantially equal to the actual location.

Figure 4:
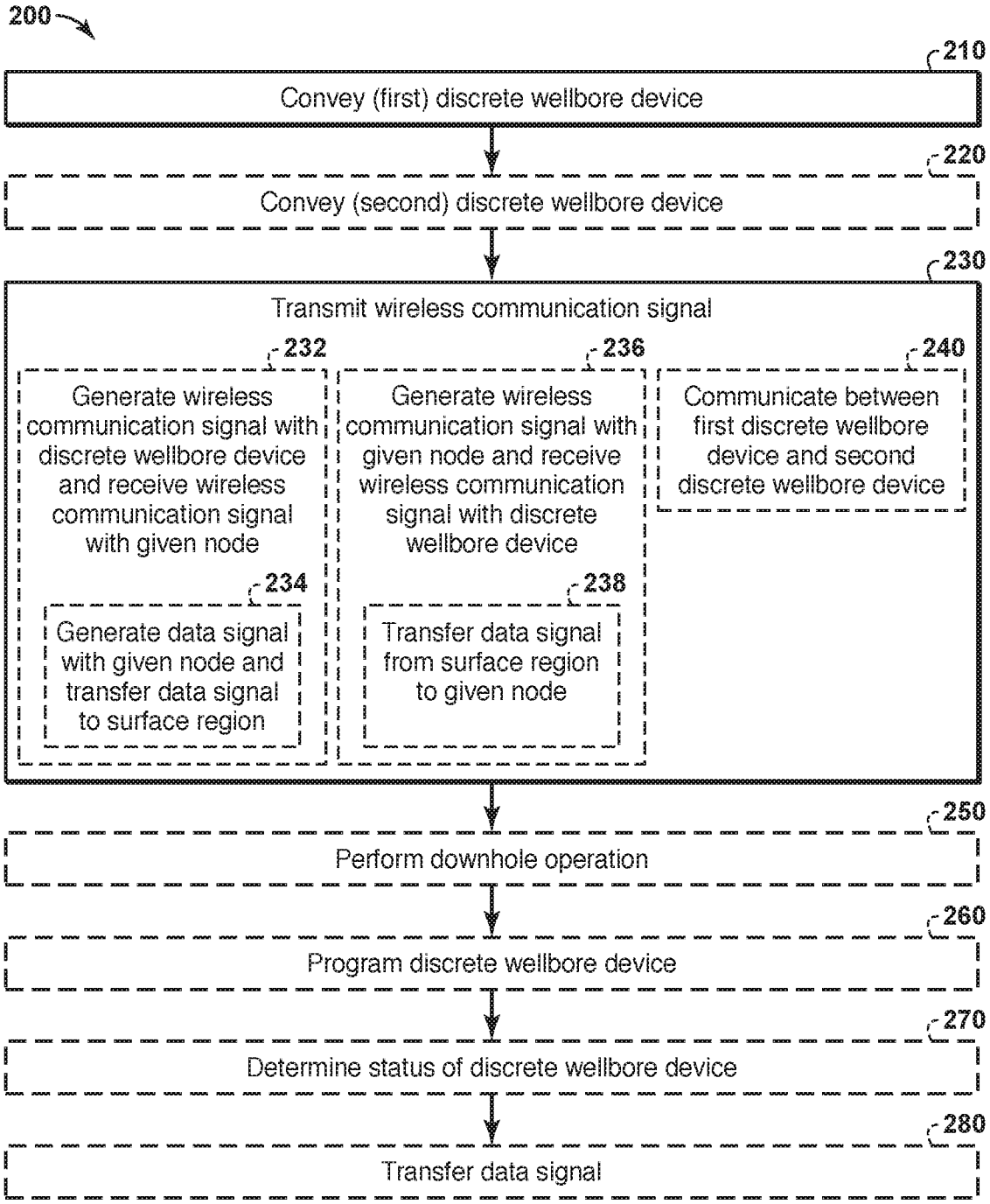
FIG. 4 is a flowchart depicting methods, according to the present disclosure, of operating a discrete wellbore device.

FIG. 4 is a flowchart depicting methods 200, according to the present disclosure, of operating a discrete wellbore device. The methods may be at least partially performed within a wellbore conduit that may be defined by a wellbore tubular that extends within a subterranean formation. A downhole communication network that includes a plurality of nodes may extend along the wellbore conduit and may be configured to transfer a data signal along the wellbore conduit and/or to and/or from a surface region.

Methods 200 include conveying a (first) discrete wellbore device within the wellbore conduit at 210 and may include conveying a second discrete wellbore device within the wellbore conduit at 220. Methods 200 further include transmitting a wireless communication signal at 230 and may include performing a downhole operation at 250 and/or programming the discrete wellbore device at 260. Methods 200 further may include determining a status of the discrete wellbore device at 270 and/or transferring a data signal at 280.

Conveying the (first) discrete wellbore device within the wellbore conduit at 210 may include conveying the (first) discrete wellbore device in any suitable manner Examples of the conveying at 210 are disclosed herein with reference to the conveying at 110 of methods 100.

Conveying the second discrete wellbore device within the wellbore conduit at 220 may include conveying the second discrete wellbore device within the wellbore conduit while the first discrete wellbore device is located within and/or being conveyed within the wellbore conduit. Thus, the conveying at 220 may be at least partially concurrent with the conveying at 210. Examples of the conveying at 220 are disclosed herein with reference to the conveying at 110 of methods 100.

Transmitting the wireless communication signal at 230 may include transmitting any suitable wireless communication signal between the discrete wellbore device and a given node of the plurality of nodes of the downhole communication network. Examples of the wireless communication signal are disclosed herein.

The transmitting at 230 may include transmitting while the discrete wellbore device is located within the wellbore conduit and/or within a subterranean portion of the wellbore conduit. Thus, the transmitting at 230 may include transmitting through and/or via a wellbore fluid that may extend within the wellbore conduit and/or that may separate the discrete wellbore device from the given node of the downhole communication network. In addition, the transmitting at 230 may be at least partially concurrent with the conveying at 210 and/or with the conveying at 220.

The transmitting at 230 further may include transmitting when, or while, the discrete wellbore device is proximate, or near, the given node of the downhole communication network. In addition, the transmitting at 230 may include transmitting the wireless communication signal from one of the discrete wellbore device and the given node and receiving the wireless communication signal with the other of the discrete wellbore device and the given node.

The transmitting at 230 may include transmitting the wireless communication signal across a transmission distance. Examples of the transmission distance include transmission distances of at least 0.1 centimeter (cm), at least 0.5 cm, at least 1 cm, at least 1.5 cm, at least 2 cm, at least 3 cm, at least 4 cm, at least 5 cm, at least 6 cm, at least 7 cm, at least 8 cm, at least 9 cm, or at least 10 cm. Additional examples of the transmission distance include transmission distances of less than 500 cm, less than 400 cm, less than 300 cm, less than 200 cm, less than 100 cm, less than 80 cm, less than 60 cm, less than 50 cm, less than 40 cm, less than 30 cm, less than 20 cm, less than 10 cm, or less than 5 cm.

The transmitting at 230 may include transmitting any suitable wireless communication signal between the discrete wellbore device and the given node of the downhole communication network. As an example, the transmitting at 230 may include transmitting a wireless depth indication signal from the given node to the discrete wellbore device. As another example, the transmitting at 230 may include transmitting a wireless query signal from the given node to the discrete wellbore device and, responsive to receipt of the wireless query signal, transmitting a wireless status signal from the discrete wellbore device to the given node. Examples of the wireless status signal are disclosed herein.

As indicated in FIG. 4 at 232, the transmitting at 230 may include generating the wireless communication signal with the discrete wellbore device and receiving the wireless communication signal with the given node of the downhole communication network. Responsive to receipt of the wireless communication signal, and as indicated at 234, the method may include generating the data signal with the given node and transferring the data signal toward and/or to the surface region with the downhole communication network. The data signal may be based, at least in part, on the wireless communication signal.

The wireless communication signal that is generated by the discrete wellbore device may include a wireless status signal that is indicative of a status of the discrete wellbore device. Examples of the status of the discrete wellbore device include a temperature proximal the discrete wellbore device within the wellbore conduit, a pressure proximal the discrete wellbore device within the wellbore conduit, a velocity of the discrete wellbore device within the wellbore conduit, a location of the discrete wellbore device within the wellbore conduit, a depth of the discrete wellbore device within the subterranean formation, and/or an operational state of the discrete wellbore device.

As indicated in FIG. 4 at 236, the transmitting at 230 additionally or alternatively may include generating the wireless communication signal with the given node of the downhole communication network and receiving the wireless communication signal with the discrete wellbore device. As indicated at 238 the method further may include transferring the data signal from the surface region to the given node. The given node may generate the wireless communication signal based, at least in part, on the data signal.

Method 200 further may include performing a downhole operation with the discrete wellbore device responsive to receipt of the wireless communication signal by the discrete wellbore device, as indicated in FIG. 4 at 250. Additionally or alternatively, methods 200 may include programming the discrete wellbore device responsive to receipt of the wireless communication signal by the discrete wellbore device, as indicated in FIG. 4 at 260.

As indicated in FIG. 4 at 240, the transmitting at 230 additionally or alternatively may include communicating between the first discrete wellbore device and the second discrete wellbore device by generating the wireless communication signal with the first discrete wellbore device and receiving the wireless communication signal with the second discrete wellbore device. This communication may be at least partially concurrent with the conveying at 210 and/or with the conveying at 220.

The communicating at 240 may include direct transmission of the data signal between the first discrete wellbore device and the second discrete wellbore device. As an example, the communicating at 240 may include generating a direct wireless communication signal with the first discrete wellbore device and (directly) receiving the direct wireless communication signal with the second discrete wellbore device.

The communicating at 240 also may include indirect transmission of the data signal between the first discrete wellbore device and the second discrete wellbore device. As an example, the communicating at 240 may include transmitting a first wireless communication signal from the first discrete wellbore device to a first given node of the downhole communication network. The communicating further may include generating the data signal with the first given node, with the data signal being based upon the first wireless communication signal. The communicating at 240 then may include transferring the data signal from the first given node to a second given node of the downhole communication network, with the second given node being proximate the second discrete wellbore device. Subsequently, the communicating at 240 may include generating a second wireless communication signal with the second given node, with the second wireless communication signal being based upon the data signal. The communicating at 240 then may include transmitting the second wireless communication signal from the second given node to the second discrete wellbore device and/or receiving the second wireless communication signal with the second discrete wellbore device.

Performing the downhole operation at 250 may include performing any suitable downhole operation with the discrete wellbore device. As an example, the discrete wellbore device may include a perforation device that is configured to form a perforation within the wellbore tubular responsive to receipt of a wireless perforation signal from the downhole communication network and/or from the given node thereof. Under these conditions, the transmitting at 230 may include transmitting the wireless perforation signal to the discrete downhole device, and the performing at 250 may include perforating the wellbore tubular.

As additional examples, the discrete wellbore device may include a plug and/or a packer that may be configured to at least partially, or even completely, block and/or occlude the wellbore conduit responsive to receipt of a wireless actuation signal from the downhole communication network and/or from the given node thereof. Under these conditions, the transmitting at 230 may include transmitting the wireless actuation signal to the discrete wellbore device, and the performing at 250 may include at least partially blocking and/or occluding the wellbore conduit.

Programming the discrete wellbore device at 260 may include programming and/or re-programming the discrete wellbore device via the wireless communication signal. As an example, the discrete wellbore device may include a control structure that is configured to control the operation of at least a portion of the discrete wellbore device. Under these conditions, the transmitting at 230 may include transmitting a wireless communication signal that may be utilized by the discrete wellbore device to program and/or re-program the control structure.

Determining the status of the discrete wellbore device at 270 may include determining any suitable status of the discrete wellbore device. When methods 270 include the determining at 270, the transmitting at 230 may include transmitting a wireless query signal to the discrete wellbore device from the downhole communication network and subsequently transmitting a wireless status signal from the discrete wellbore device to the downhole communication network. The wireless status signal may be generated by the discrete wellbore device responsive to receipt of the wireless query signal and may indicate and/or identify the status of the discrete wellbore device. Additionally or alternatively, the determining at 270 may include determining the status of the discrete wellbore device without receiving a wireless communication signal from the discrete wellbore device. Examples of the status of the discrete wellbore device are disclosed herein.

As an example, the determining at 270 may include determining that a depth of the discrete wellbore device within the subterranean formation is greater than a threshold arming depth. Methods 200 then may include performing the transmitting at 230 to transmit a wireless arming signal to the discrete wellbore device responsive to determining that the depth of the discrete wellbore device is greater than the threshold arming depth.

As another example, the determining at 270 additionally or alternatively may include determining that the discrete wellbore device is within a target region of the wellbore conduit. Methods 200 then may include performing the transmitting at 230 to transmit the wireless actuation signal and/or the wireless perforation signal to the discrete wellbore device responsive to determining that the discrete wellbore device is within the target region of the wellbore conduit. Under these conditions, the transmitting at 230 further may include receiving the wireless actuation signal and/or the wireless perforation signal with the discrete wellbore device and performing the downhole operation responsive to receiving the wireless actuation signal and/or the wireless perforation signal.

As yet another example, the determining at 270 additionally or alternatively may include determining that (or if) the downhole operation was performed successfully during the performing at 250. This may include determining that (or if) the perforation device, the plug, and/or the packer was actuated successfully. Under these conditions, the transmitting at 230 may include transmitting a successful actuation signal via the downhole communication network and/or to the surface region responsive to determining that the downhole operation was performed successfully.

As another example, the determining at 270 additionally or alternatively may include determining that (or if) the downhole operation was performed unsuccessfully during the performing at 250. This may include determining that (or if) the perforation device, the plug, and/or the packer was actuated unsuccessfully. Under these conditions, the transmitting at 230 may include transmitting an unsuccessful actuation signal via the downhole communication network and/or to the surface region responsive to determining that the downhole operation was performed unsuccessfully.

As yet another example, the determining at 270 additionally or alternatively may include determining that (or if) the discrete wellbore device is experiencing a fault condition. Under these conditions, the transmitting at 230 may include transmitting a wireless fault signal from the discrete wellbore device to the downhole communication network responsive to determining that the discrete wellbore device is experiencing the fault condition. In addition, methods 200 further may include disarming the discrete wellbore device responsive to determining that the discrete wellbore device is experiencing the fault condition. This may include transmitting a wireless disarming signal to the discrete wellbore device from the surface region, via the downhole communication network, and/or from the given node of the downhole communication network.

Methods 200 also may include aborting operation of the discrete wellbore device responsive to determining that the discrete wellbore device is experiencing the fault condition and/or determining that the downhole operation was performed unsuccessfully. Under these conditions, the transmitting at 230 may include transmitting a wireless abort signal to the discrete wellbore device from the surface region, via the downhole communication network, and/or from the given node of the downhole communication network. In the context of a wellbore tool that includes a perforation device, the aborting may include sending a disarm command signal to the discrete wellbore device or otherwise disarming the perforation device.

Methods 200 also may include initiating self-destruction of the discrete wellbore device responsive to determining that the discrete wellbore device is experiencing the fault condition and/or determining that the downhole operation was performed unsuccessfully. Under these conditions, the transmitting at 230 may include transmitting a wireless self-destruct signal to the discrete wellbore device from the surface region, via the downhole communication network, and/or from the given node of the downhole communication network.

Transferring the data signal at 280 may include transferring the data signal along the wellbore conduit, from the surface region, to the subterranean formation, from the subterranean formation, and/or to the surface region via the downhole communication network and may be performed in any suitable manner. As an example, the plurality of nodes may be spaced apart along the wellbore conduit by a node-to-node separation distance, and the transferring at 280 may include transferring between adjacent nodes and across the node-to-node separation distance. Examples of the node-to-node separation distance are disclosed herein. As disclosed herein, the transferring at 280 may include wired or wireless transfer of the data signal, and examples of the data signal are disclosed herein.

In the present disclosure, several of the illustrative, non-exclusive examples have been discussed and/or presented in the context of flow diagrams, or flow charts, in which the methods are shown and described as a series of blocks, or steps. Unless specifically set forth in the accompanying description, it is within the scope of the present disclosure that the order of the blocks may vary from the illustrated order in the flow diagram, including with two or more of the blocks (or steps) occurring in a different order and/or concurrently. It is also within the scope of the present disclosure that the blocks, or steps, may be implemented as logic, which also may be described as implementing the blocks, or steps, as logics. In some applications, the blocks, or steps, may represent expressions and/or actions to be performed by functionally equivalent circuits or other logic devices. The illustrated blocks may, but are not required to, represent executable instructions that cause a computer, processor, and/or other logic device to respond, to perform an action, to change states, to generate an output or display, and/or to make decisions.

As used herein, the term "and/or" placed between a first entity and a second entity means one of (1) the first entity, (2) the second entity, and (3) the first entity and the second entity. Multiple entities listed with "and/or" should be construed in the same manner, i.e., "one or more" of the entities so conjoined. Other entities may optionally be present other than the entities specifically identified by the "and/or" clause, whether related or unrelated to those entities specifically identified. Thus, as a non-limiting example, a reference to "A and/or B," when used in conjunction with open-ended language such as "comprising" may refer, in one embodiment, to A only (optionally including entities other than B); in another embodiment, to B only (optionally including entities other than A); in yet another embodiment, to both A and B (optionally including other entities). These entities may refer to elements, actions, structures, steps, operations, values, and the like.

As used herein, the phrase "at least one," in reference to a list of one or more entities should be understood to mean at least one entity selected from any one or more of the entity in the list of entities, but not necessarily including at least one of each and every entity specifically listed within the list of entities and not excluding any combinations of entities in the list of entities. This definition also allows that entities may optionally be present other than the entities specifically identified within the list of entities to which the phrase "at least one" refers, whether related or unrelated to those entities specifically identified. Thus, as a non-limiting example, "at least one of A and B" (or, equivalently, "at least one of A or B," or, equivalently "at least one of A and/or B") may refer, in one embodiment, to at least one, optionally including more than one, A, with no B present (and optionally including entities other than B); in another embodiment, to at least one, optionally including more than one, B, with no A present (and optionally including entities other than A); in yet another embodiment, to at least one, optionally including more than one, A, and at least one, optionally including more than one, B (and optionally including other entities). In other words, the phrases "at least one," "one or more," and "and/or" are open-ended expressions that are both conjunctive and disjunctive in operation. For example, each of the expressions "at least one of A, B, and C," "at least one of A, B, or C," "one or more of A, B, and C," "one or more of A, B, or C" and "A, B, and/or C" may mean A alone, B alone, C alone, A and B together, A and C together, B and C together, A, B and C together, and optionally any of the above in combination with at least one other entity.

In the event that any patents, patent applications, or other references are incorporated by reference herein and (1) define a term in a manner that is inconsistent with and/or (2) are otherwise inconsistent with, either the non-incorporated portion of the present disclosure or any of the other incorporated references, the non-incorporated portion of the present disclosure shall control, and the term or incorporated disclosure therein shall only control with respect to the reference in which the term is defined and/or the incorporated disclosure was present originally.

As used herein the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa.

As used herein, the phrase, "for example," the phrase, "as an example," and/or simply the term "example," when used with reference to one or more components, features, details, structures, embodiments, and/or methods according to the present disclosure, are intended to convey that the described component, feature, detail, structure, embodiment, and/or method is an illustrative, non-exclusive example of components, features, details, structures, embodiments, and/or methods according to the present disclosure. Thus, the described component, feature, detail, structure, embodiment, and/or method is not intended to be limiting, required, or exclusive/exhaustive; and other components, features, details, structures, embodiments, and/or methods, including structurally and/or functionally similar and/or equivalent components, features, details, structures, embodiments, and/or methods, are also within the scope of the present disclosure.

INDUSTRIAL APPLICABILITY

The systems and methods disclosed herein are applicable to the oil and gas industries.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to one of the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower, or equal in scope to the original claims, are also regarded as included within the subject matter of the inventions of the present disclosure.

What is claimed is:

1. A method of determining a location of a discrete wellbore device within a wellbore conduit that is defined by a wellbore tubular, the method comprising:

conveying the discrete wellbore device within the wellbore conduit;

wirelessly detecting proximity of the discrete wellbore device to a node of an acoustic downhole communication network comprising a plurality of acoustic transmission nodes that extend along the wellbore tubular, wherein the plurality of acoustic transmission nodes comprise a series of nodes provided on the wellbore tubular, each node includes an acoustic transmission receiver and an acoustic transmission transmitter;

responsive to the wirelessly detecting, generating a location indication signal with the node; and transferring the location indication signal to a surface region with the downhole communication network;

wherein the discrete wellbore device is configured within the wellbore conduit in an untethered manner, and wherein the location indication signal is conveyed through the wellbore tubular between the acoustic transmission transmitter and the acoustic transmission receiver.

2. The method of claim 1, wherein the wirelessly detecting includes detecting with a sensor that forms a portion of the node.

3. The method of claim 2, wherein the sensor includes at least one of:

(i) an acoustic sensor configured to detect a sound indicative of proximity of the discrete wellbore device to the node;

(ii) a pressure sensor configured to detect a pressure change indicative of proximity of the discrete wellbore device to the node;

(iii) a vibration sensor configured to detect vibration indicative of proximity of the discrete wellbore device to the node;

(iv) an electric field sensor configured to detect an electric field indicative of proximity of the discrete wellbore device to the node;

(v) a magnetic field sensor configured to detect a magnetic field indicative of proximity of the discrete wellbore device to the node;

(vi) an electromagnetic sensor configured to detect an electromagnetic field indicative of proximity of the discrete wellbore device to the node;

(vii) a radio sensor configured to detect a radio wave signal indicative of proximity of the discrete wellbore device to the node; and (viii) an optical sensor configured to detect an optical signal indicative of proximity of the discrete wellbore device to the node.

4. The method of claim 1, wherein the discrete wellbore device includes a wireless transmitter configured to generate a wireless communication signal, and further wherein the wirelessly detecting includes detecting the wireless communication signal.

5. The method of claim 1, wherein the discrete wellbore device is configured to generate a wireless location indication signal indicative of a calculated location of the discrete wellbore device within the wellbore conduit, wherein the wirelessly detecting includes detecting the wireless location indication signal.

6. The method of claim 5, wherein the method further includes comparing the calculated location of the discrete wellbore device to an actual location of the discrete wellbore device within the wellbore conduit.

7. The method of claim 6, wherein the method further includes responding if the calculated location differs from the actual location by more than a location difference threshold value, wherein the responding includes at least one of re-programming the discrete wellbore device, aborting a downhole operation of the discrete wellbore device, and calibrating the discrete wellbore device.

8. A method of operating a discrete wellbore device, the method comprising:

conveying the discrete wellbore device within a wellbore conduit that is defined by a wellbore tubular that extends within a subterranean formation, wherein an acoustic downhole communication network includes a plurality of acoustic transmission nodes that extends along the wellbore conduit and is configured to transfer a data signal along the wellbore conduit and to a surface region, wherein the plurality of acoustic transmission nodes comprise a series of nodes provided on the wellbore tubular, each node includes an acoustic transmission receiver and an acoustic transmission transmitter; and transmitting a wireless communication signal between the discrete wellbore device and a given node of the plurality of nodes when the discrete wellbore device is within a subterranean portion of the wellbore conduit;

wherein the discrete wellbore device is configured within the wellbore conduit in an untethered manner, and wherein the data signal is conveyed through the wellbore tubular between the acoustic transmission transmitter and the acoustic transmission receiver.

9. The method of claim 8, wherein the transmitting includes transmitting the wireless communication signal from one of the discrete wellbore device and the given node and receiving the wireless communication signal with the other of the discrete wellbore device and the given node.

10. The method of claim 8, wherein the transmitting includes generating the wireless communication signal with the discrete wellbore device and receiving the wireless communication signal with the given node.

11. The method of claim 10, wherein the method further includes generating the data signal with the given node, wherein the data signal is based upon the wireless communication signal, and further wherein the method includes transferring the data signal to the surface region with the downhole communication network.

12. The method of claim 9, wherein the transmitting includes generating the wireless communication signal with the given node and receiving the wireless communication signal with the discrete wellbore device.

13. The method of claim 12, wherein the method further includes transferring the data signal from the surface region to the given node with the downhole communication network, and further wherein the wireless communication signal is based upon the data signal.

14. The method of claim 12, wherein the method further includes at least one of:

(i) performing a downhole operation with the discrete wellbore device responsive to receipt of the wireless communication signal; and (ii) reprogramming the discrete wellbore device responsive to receipt of the wireless communication signal.

15. The method of claim 8, wherein, responsive to the transmitting, the method further includes transferring a location indication signal along the wellbore conduit with the downhole communication network to notify an operator that the discrete wellbore device is proximate the given node, wherein the transmitting is at least partially concurrent with the conveying.

16. The method of claim 8, wherein the transmitting includes:

(i) transmitting a wireless query signal from the given node to the discrete wellbore device; and (i) responsive to receipt of the wireless query signal, transmitting a wireless status signal from the discrete wellbore device to the given node.

17. The method of claim 8, wherein the method further includes programming a control structure of the discrete wellbore device based upon the wireless communication signal.

18. The method of claim 8, wherein the discrete wellbore device includes a perforation device that is configured to form a perforation within the wellbore tubular responsive to receipt of a wireless perforation signal from the given node of the downhole communication network.

19. The method of claim 18, wherein the method further includes determining that the discrete wellbore device is within a target region of the wellbore conduit, wherein the wireless communication signal includes the wireless perforation signal, and further wherein the transmitting includes transmitting the wireless perforation signal from the given node to the discrete wellbore device responsive to determining that the discrete wellbore device is within the target region of the wellbore conduit.

20. The method of claim 19, wherein the method further includes receiving the wireless perforation signal with the discrete wellbore device and actuating the perforation device responsive to receiving the wireless perforation signal.

21. The method of claim 20, wherein the method further includes determining that the perforation device was successfully actuated and transmitting a successful actuation signal via the downhole communication network responsive to determining that the perforation device was successfully actuated.

22. The method claim 20, wherein the method further includes determining that the perforation device was unsuccessfully actuated and transmitting an unsuccessful actuation signal via the downhole communication network responsive to determining that the perforation device was unsuccessfully actuated.

23. The method of claim 8, wherein the method further includes determining that the discrete wellbore device is within a target region of the wellbore conduit, wherein the wireless communication signal includes a wireless actuation signal, and further wherein the transmitting includes transmitting the wireless actuation signal from the given node to the discrete wellbore device responsive to determining that the discrete wellbore device is within the target region of the wellbore conduit.

24. The method of claim 23, wherein the method further includes receiving the wireless actuation signal with the discrete wellbore device and actuating the discrete wellbore device responsive to receiving the wireless actuation signal.

25. The method of claim 23, wherein the method further includes determining that the discrete wellbore device was successfully actuated and transmitting a successful actuation signal from the discrete wellbore device to the downhole communication network responsive to determining that the discrete wellbore device was successfully actuated.

26. The method of claim 23, wherein the method further includes determining that the discrete wellbore device was unsuccessfully actuated and transmitting an unsuccessful actuation signal from the discrete wellbore device to the downhole communication network responsive to determining that the discrete wellbore device was unsuccessfully actuated.

27. The method of claim 8, wherein the method further includes determining that the discrete wellbore device is experiencing a fault condition and transmitting a wireless fault signal from the discrete wellbore device to the downhole communication network responsive to determining that the discrete wellbore device is experiencing the fault condition.

28. The method of claim 27, wherein the method further includes disarming the discrete wellbore device responsive to determining that the discrete wellbore device is experiencing the fault condition.

29. The method of claim 27, wherein the method further includes initiating self-destruction of the discrete wellbore device responsive to determining that the discrete wellbore device is experiencing the fault condition.

30. The method of claim 27, wherein the wireless communication signal includes a wireless abort signal, and further wherein the transmitting includes transmitting the wireless abort signal from the given node to the discrete wellbore device responsive to determining that the discrete wellbore device is experiencing the fault condition.

31. The method of claim 27, wherein the wireless communication signal includes a wireless self-destruct signal, and further wherein the transmitting includes transmitting the wireless self-destruct signal from the given node to the discrete wellbore device responsive to determining that the discrete wellbore device is experiencing the fault condition.

32. The method of claim 8, wherein the discrete wellbore device is a first discrete wellbore device, and further wherein the method includes conveying a second discrete wellbore device within the wellbore conduit concurrently with conveying the first discrete wellbore device.

33. The method of claim 32, wherein the given node is a first given node, wherein the wireless communication signal is a first wireless communication signal, and further wherein the method includes communicating between the first discrete wellbore device and the second discrete wellbore device by:

(i) transmitting the first wireless communication signal from the first discrete wellbore device to the first given node;

(ii) generating the data signal with the first given node based upon the first wireless communication signal;

(iii) transferring the data signal from the first given node to a second given node that is proximate the second discrete wellbore device;

(iv) generating a second wireless communication signal with the second given node based upon the data signal; and (v) transmitting the second wireless communication signal from the second given node to the second discrete wellbore device.

34. The method of claim 32, wherein the method further includes communicating between the first discrete wellbore device and the second discrete wellbore device by:

(i) generating a direct wireless communication signal with the first discrete wellbore device; and (ii) receiving the direct wireless communication signal with the second discrete wellbore device.

35. The method of claim 34, wherein the communicating is at least partially concurrent with the conveying the first discrete wellbore device and the conveying the second discrete wellbore device.

* * * * *